US006148089A

United States Patent [19]

Akino

[11] Patent Number: 6,148,089

[45] Date of Patent: Nov. 14, 2000

[54] UNIDIRECTIONAL MICROPHONE

[75] Inventor: Hiroshi Akino, Sagamihara, Japan

[73] Assignee: Kabushiki Kaisha Audio Technica, Tokyo, Japan

[21] Appl. No.: 09/337,950

[22] Filed: Jun. 22, 1999

[30] Foreign Application Priority Data

Jul. 10, 1998 [JP] Japan ..... 10-196315

[51] Int. Cl.[7] ..... H04R 25/00

[52] U.S. Cl. ..... 381/356; 381/355; 381/357; 381/365

[58] Field of Search ..... 381/355, 356, 381/357, 358, 361, FOR 147, FOR 148, 306, 333, 388, 365; 361/681, 682, 683

[56] References Cited

U.S. PATENT DOCUMENTS 4,850,016 7/1989 Groves et al. ..... 381/356

5,627,901 5/1997 Josephson et al. ..... 381/361

5,970,159 10/1999 McIntosh ..... 381/361

*Primary Examiner*—Huyen Le

*Attorney, Agent, or Firm*—Welsh & Katz, Ltd.

[57] ABSTRACT

An unidirectional microphone comprising a microphone unit 2 having a front acoustic terminal 21 and a rear acoustic terminal 22, which is provided in a flat-faced surface F2 of such as an outer frame of a display panel for computer, includes a unit fitting portion F1 provided on the flat-faced surface F2 for fitting said microphone unit 2, the top surface of the plane F2 being flat with respect to the top surface of the front acoustic terminal 21 of the microphone unit 2, a baffle plate 3 mounted on the side of the front acoustic terminal 21 of the microphone unit 2 to be disposed in the opening surface of the unit fitting portion F1, and a side acoustic terminal 4 provided about the baffle plate 3 in communication with the rear acoustic terminal 22.

18 Claims, 10 Drawing Sheets

UNIDIRECTIONAL MICROPHONE

FIELD OF THE INVENTION

The present invention relates to a microphone having an unidirectivity, and more specifically to an unidirectional microphone to be mounted on a note-book or mobile system personal computer.

BACKGROUND OF THE INVENTION

Popular types of built-in type microphones to be mounted on a disk-top system personal computer or a mobile system personal computer (hereinafter referred to as a personal computer) include a non-directional condenser microphone and a boundary microphone.

A condenser microphone is a non-directional microphone which is not much affected by a breath of a speaker or wind. Therefore, the microphone can be made relatively flat with respect to a flat face on which a keyboard or a display panel is provided, and fit in a flat face of housing for a thin shaped personal computer. However, since the condenser microphone is the non-directional microphone, it is designated to provide a small difference between the surrounding noise and the objective sound. Therefore, there is a tendency for such the microphone to have difficulties in catching excellent sound and imparting the personal computer to normally recognize voice sound.

Conversely, the boundary microphone is parallel to a fat-faced surface of the housing on which the keyboard or the display panel is provided, when it is mounted on the personal computer. Therefore, the length of that direct sound transmits from the outside into a front acoustic terminal, would be generally same as the length of that a reflected sound by the mounted surface transmits into the front acoustic terminal. Thereby, it is possible to prevent the microphone from a loss in clarity of sound quality caused by their different phases.

However, in the case of the boundary microphone, in order to input a clearer sound from a voice of a speaker, a main axis of the microphone has to be directed toward the speaker. Particularly, since a personal computer was often set on a desk or on a speaker's legs, the keyboard surface or the display panel surface of the computer with the built-in boundary microphone would not always be directed toward the speaker. Therefore, for the personal computer which clearer input voice is required, it is not reasonable to incorporate the built-in boundary microphone in the personal computer.

It can be considered that the unidirectional microphone capable of detecting only the front voice would be built in the personal computer in place of the non-directional microphone. However, a size of the unidirectional microphone has to be considered. Because the unidirectional microphone has a shape of an elongate or an oblong construction, since the design enables a sound input from both front and back sides of a diaphragm of the unidirectional microphone.

When the unidirectional microphone is fit in a flat-faced housing surface of the personal computer, not only stylish design but also compact design for the microphone are required. Therefore, the unidirectional microphone should not be increased in a thickness of main body thereof, when it is mounted on the personal computer.

On the other hand, it is considered that a recess would be provided on the housing surface of the personal computer with the keyboard or a display panel for fitting an unidirectional microphone therein. However, in such the way, the adequate pressure gradient would not be obtained, since the unidirectional microphone did not have different sound pressures between the front acoustic terminal and a rear acoustic terminal. Therefore, there is a problem that an unidirectional performance of the unidirectional microphone falls to a performance near the non-directional microphone, despite of unidirectivity.

SUMMARY OF THE INVENTION

From a viewpoint of the above-described problems, an object of the present invention is to provide an unidirectional microphone which is fit in a flat-faced housing surface of a personal computer having a keyboard or a display panel provided thereon with the keyboard or the display panel not protruding from the flat faced surface.

For achieving the aforementioned object, according to the present invention, there is provided an unidirectional microphone including a microphone unit having a front acoustic terminal and a rear acoustic terminal, a baffle plate in which the front acoustic terminal of the microphone unit is fitted at a center there of and whose top face is at same level as to a top face of the front acoustic terminal, and a side acoustic terminal provided about the baffle plate and coupled to and communicated with said rear acoustic terminal, the unidirectional microphone being fit, in use, in a unit fitting portion formed in a flat-faced housing surface of a personal computer for fitting a microphone unit therein and having diameter longer than that of said side acoustic terminal and depth lower than the axial length of the microphone unit.

Correspondingly with the constitution described above, in the unidirectional microphone according to the present invention, since the sound wave from the sound source is caught by the front acoustic terminal while passing thorough the side acoustic terminal prior to coming into the rear acoustic terminal in the unit receiving portion, the pressure gradient is adequately measured between the front acoustic terminal and the rear acoustic terminal to produce an excellent unidirectional characteristic.

Preferably, according to the present invention, a diameter of the baffle plate for covering the unit fitting portion formed by a recess is made substantially smaller than that of the unit fitting portion, and an air leaking passage which is used as the side acoustic terminal, is provided between the unit fitting portion and the baffle plate. Thereby, a number of processing steps is reduced.

Furthermore, the present invention includes an embodiment such that a hole is bored in a peripheral edge surface of the baffle plate by which the unit fitting portion as a whole is covered. Thereby, the hole may be used as the side acoustic terminal.

Furthermore, preferably, according to the present invention, the side acoustic terminal may be arranged symmetrically about the front acoustic terminal. Thereby, in the case of that a sound source on the spherical surface side is at distant position from the microphone unit, the sound waves transmitting to the front acoustic terminal and the side acoustic terminal is in same phase so that the unidirectional microphone unit produces only the sensitivity of the non-directional component.

Furthermore, the unidirectional microphone of the present invention can keep a noise from a distant point at a low level, since the incident sound pressure relative to the unidirectional microphone falls in inverse proportion to a distance from a sound source, while a voice of a speaker at a short distance has a phase differential between the front acoustic terminal and the side acoustic terminal in a spherical wave propagated from the sound source. Therefore, the microphone unit operates adequately to provide an unidirectivity.

Furthermore, according to the present invention, the side acoustic terminal may be arranged asymmetrically with the front acoustic terminal. Thereby, it is possible to deviate the acoustic directivity axis from the main axis (directional shaft) of the unit. That is, even if the main axis of the microphone unit is vertical to the plane, the acoustic directivity axis can incline in a predetermined direction (for example, in a direction of a speaker).

Furthermore, the present invention includes unidirectional microphones arranged on both left and right ends of the flat-faced housing surface having a keyboard or a display provided in a personal computer so that they can be used simply as a stereo microphone.

In addition, according to the present invention, waterproof means for covering an opening surface of the unit fitting portion is provided on the flat-faced surface so that a water-proof for the front acoustic terminal and the rear acoustic terminal of the microphone unit can be formed without separately being provided.

DESCRIPTION OF THE PREFERRED EMBODIMENTS

Figure 1:
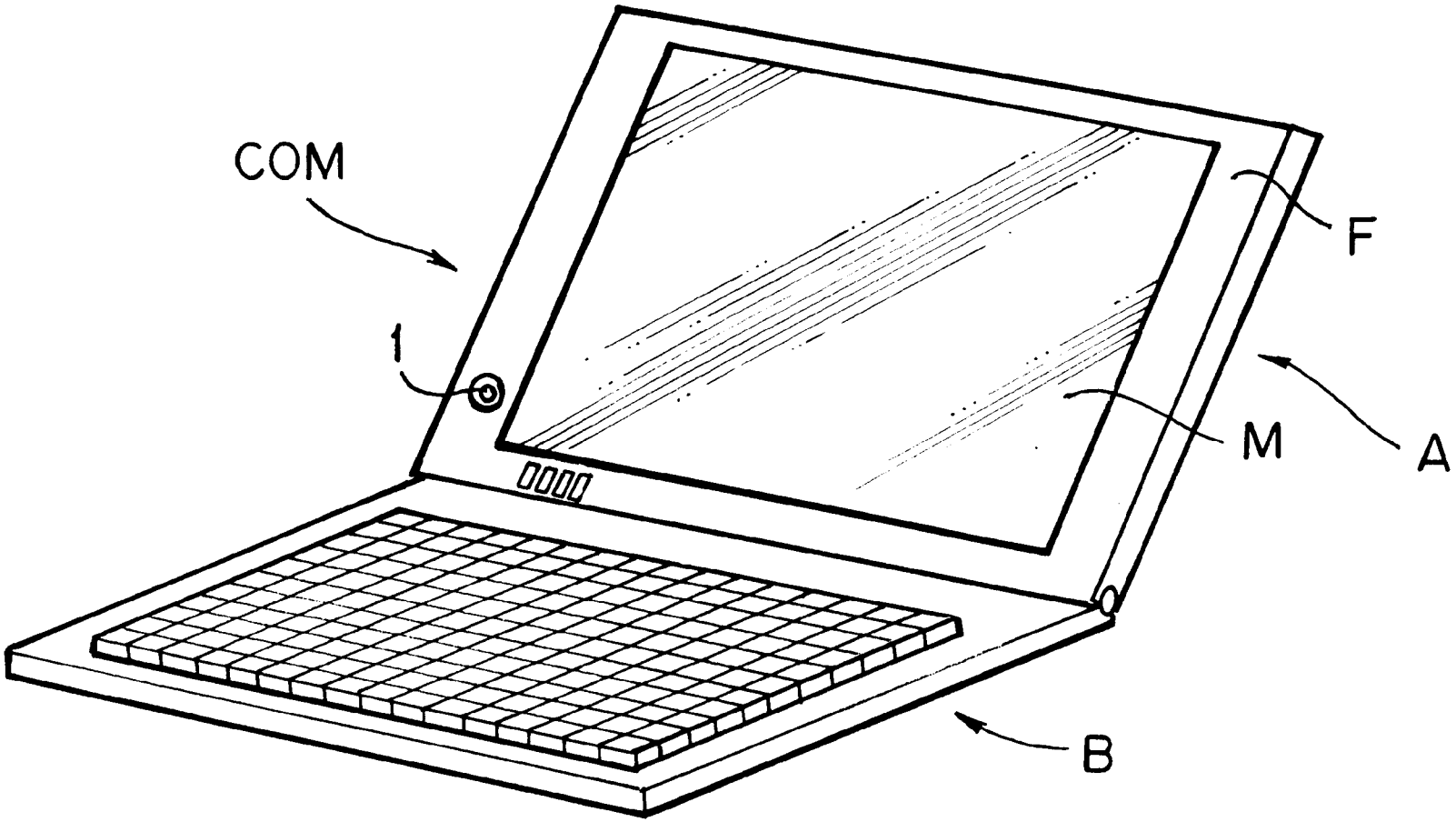
FIG. 1 is a perspective view showing a microphone in use according to a first embodiment of the present invention.

By referring to the drawings, concrete embodiments of the present invention will be given hereinafter. FIG. 1 shows a first embodiment of fitting of an unidirectional microphone into a personal computer COM, according to the present invention. Referring to FIG. 1, the personal computer COM comprises a keyboard B having keys presented in a predetermined array, the keyboard B being incorporated in housing of a personal computer body, and a display panel M which can be folded to the keyboard. A top face of a microphone 1 is held at same level position with respect to a flat-faced surface of an outer frame F of a liquid crystal display panel M provided on the display panel portion A.

Figure 2A:
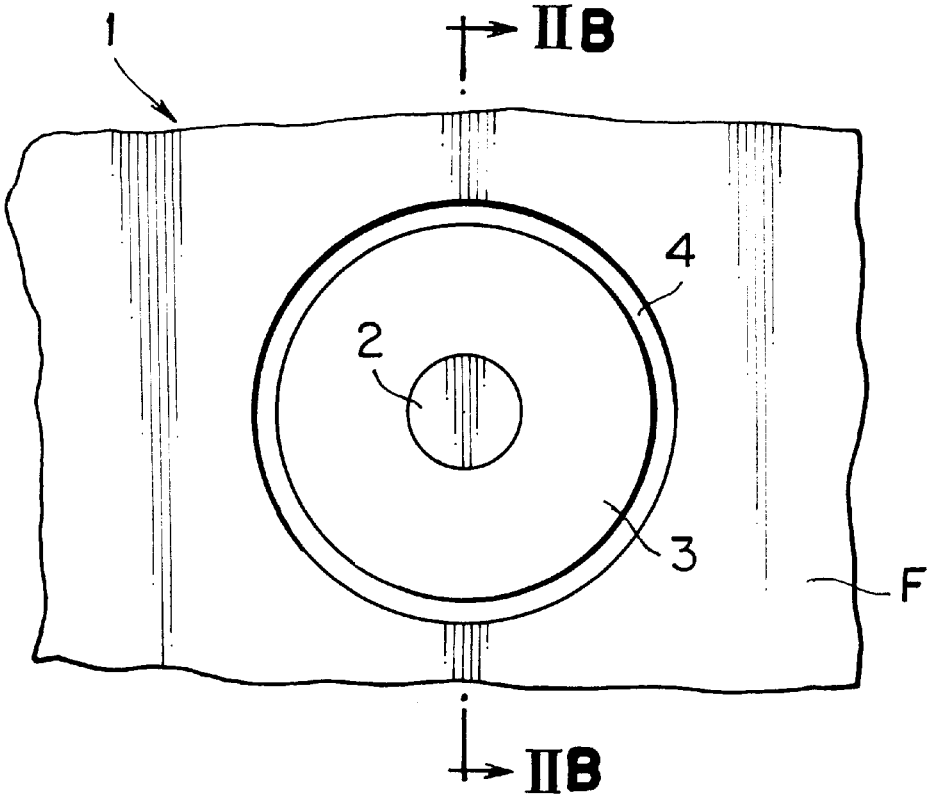
FIGS. 2A and 2B are a plane view and a sectional view taken on the line IIB—IIB of FIG. 2A of the microphone according to the first embodiment, respectively.
Figure 2B:
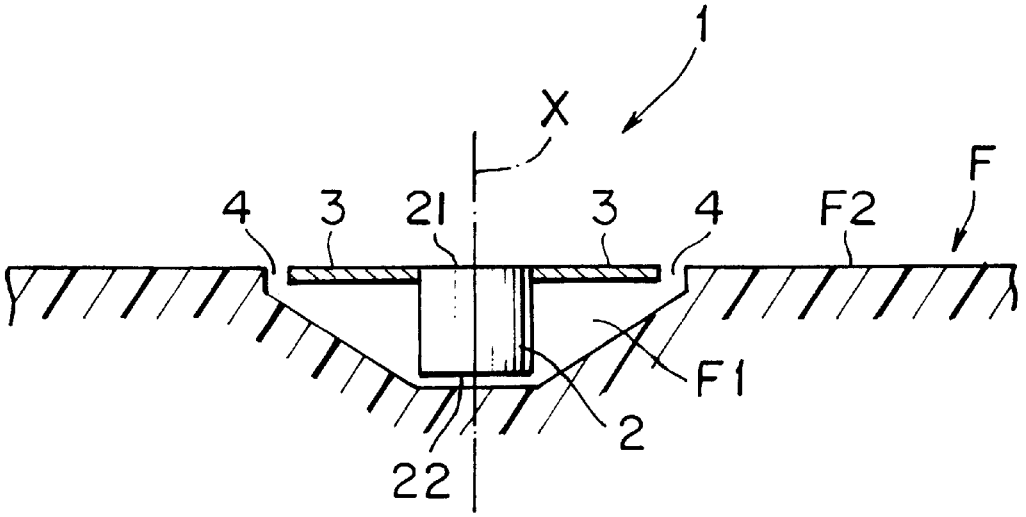

The microphone 1 of the present invention can be explained referring to FIG. 2A of a plan view of main parts, and FIG. 2B of a sectional view taken on line IIB—IIB of FIG. 2A. Referring to FIG. 2A showing the microphone illustrated from top side thereof, the microphone is fit in the frame F and has a unidirectional microphone unit 2, a baffle plate 3, and a side acoustic terminal 4.

Referring to FIG. 2B, the microphone 1 is shown as provided at a predetermined position of the outer frame F. The microphone unit 2 of the microphone 1 has a front acoustic terminal 21 having a top surface provided flat against a flat-faced surface F2 of the frame F, and a rear acoustic terminal 22 provided at a portion slightly spaced from a bottom surface of a unit fitting portion F1 formed by a recess at a predetermined position of the outer frame F. Further, the microphone unit 2 has a disk-like baffle plate 3 having a top face provided around the side of the front acoustic terminal 21 to be fitted with same level position with respect to a flat-faced surface F2 of the outer frame F.

The unit fitting portion F1 of the outer frame F is formed into a circular recess having a length longer than the axial length of the microphone unit 2 and a diameter longer than that of the baffle plate 3. The circular recess is tilted toward the bottom from a top portion thereof and generally formed into a contour of a cone type speaker.

The microphone unit 2 is disposed in such a manner that a main axis X thereof is arranged at an adequate position of the unit fitting portion F1 vertically to the plane F2 of the outer frame F, when the unit fitting portion F1 receives the microphone unit 2. In this case, the microphone unit 2 is supported by suitable supporting members (for example, such as a rubber damper) not shown, such that it is placed at an approximately center of the unit fitting portion F1 and the front acoustic terminal 21 thereof is positioned at an opening surface on which defines a circular opening of the unit fitting portion F1.

In this embodiment, the diameter of the baffle plate 3 is somewhat smaller than that of the opening surface of the unit fitting portion F1, and there is provided an air leaking portion formed into an annulus within a gap which is formed by the peripheral edges of the baffle plate 3 and the circular opening of the unit fitting portion F1. The air leaking portion is in communication with the rear acoustic terminal 22, which functions as the side acoustic terminal 4.

The baffle plate 3 is formed in a size capable of airtightly covering an opening portion of the unit fitting portion F1, and preferably, may have through-holes bored at equally spaced intervals along the periphery of the upper surface so as to form the side acoustic terminal 4.

Figure 3A:
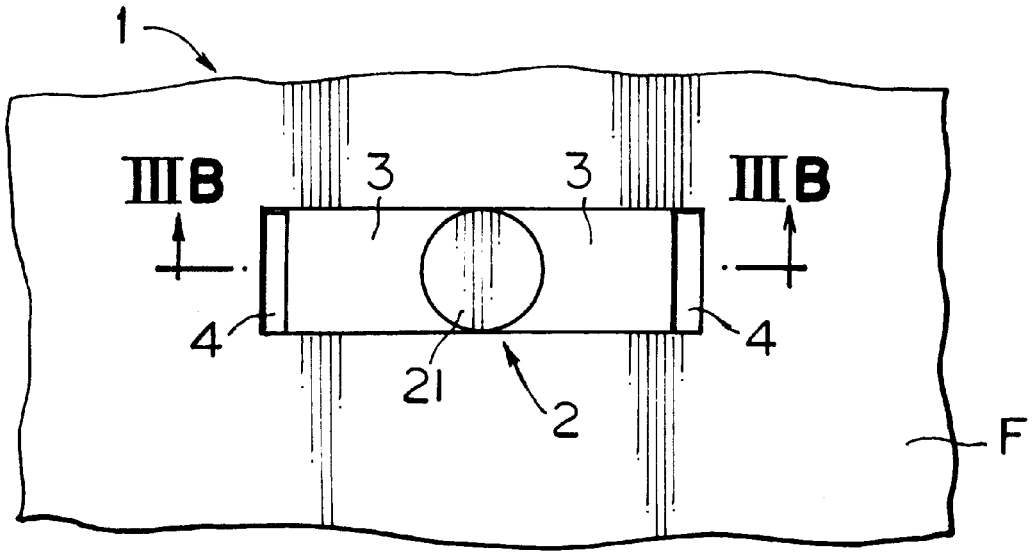
FIGS. 3A and 3B are a plan view and a sectional view taken on the line IIIB—IIIB of FIG. 3A according to the modified embodiment of the first embodiment, respectively.

According to the first embodiment, although the unit fitting portion F1 is of form of a recess having a contour like a cone speaker, the opening surface can be shaped as a rectangular as shown in FIG. 3A and a sectional view taken on IIIB—IIIB of FIG. 3A.

In this modified embodiment, the baffle plate 3 is formed in similar rectangular shape to a rectangular opening surface of the unit fitting portion F1 so that it is fitted into the unit fitting portion F1, and side acoustic terminals 4, 4 in communication with the rear acoustic terminal 22 are provided at their longitudinally opposite end positions. Thereby, the unidirectional microphone according to the present invention can be mounted on a personal computer, even if a frame of a housing of the personal computer is narrowed. The items mentioned above, the shape of the unidirectional microphone according to the present invention has been described.

Figure 4:
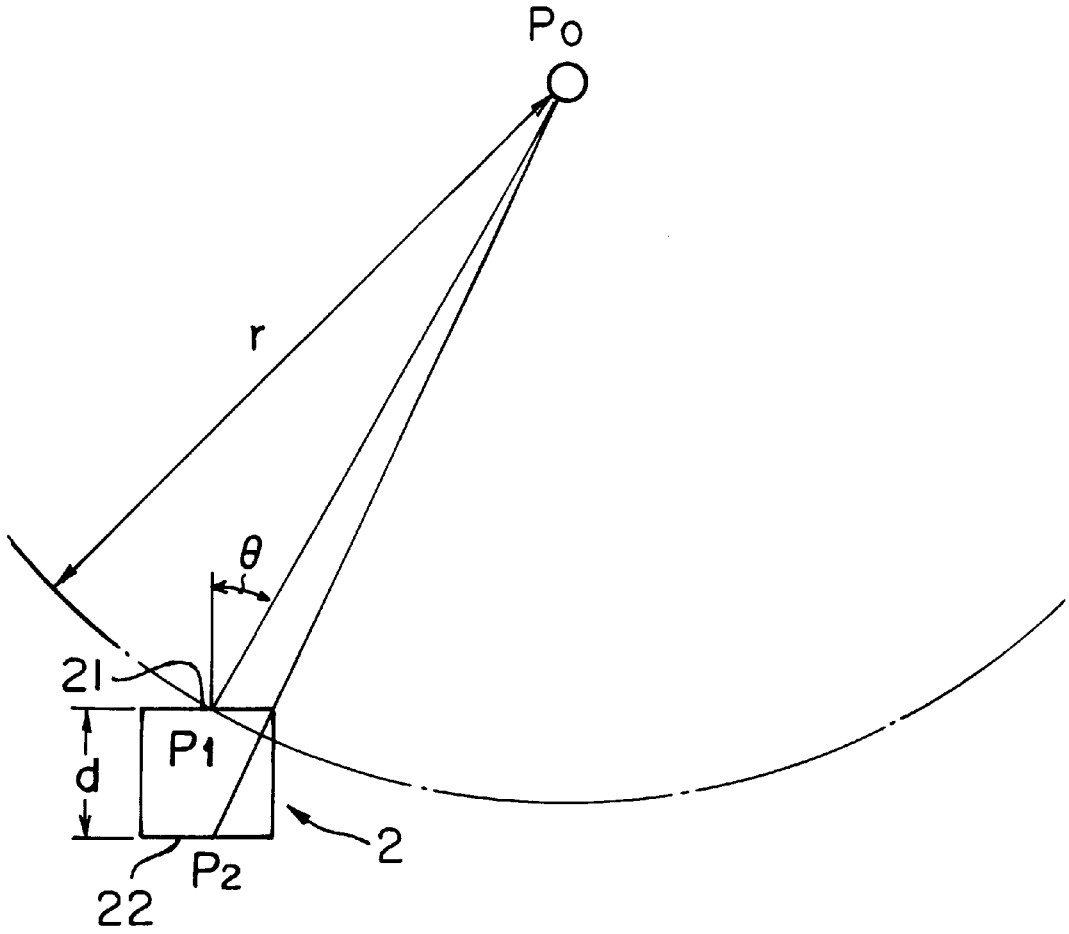
FIG. 4 is a schematic view for explaining the operating principle of an unidirectional microphone unit.

Next, the principle of the operation will be described in detail referring to FIG. 4 showing a schematic view, and the operation will be described in accordance with the above-described embodiment referring to FIGS. 5 and 6.

Referring to FIG. 4, a sound source, and a distance between the sound source and the front acoustic terminal 21 of the microphone unit 2 indicates at $P_0$, and r, respectively, wherein if $P_1$ represents a sound pressure of the front acoustic terminal 21, then the sound pressure $P_1$ formulates as follows.

$$P_1=(P_0/r)e^{j\omega(t-(r/c))}$$

(C indicates the speed of sound.) On the other hand, if $P_2$ represents a sound pressure of the rear acoustic terminal 22, then the sound pressure $P_2$ formulates as follows.

$$P_2=(P_0/(r+d\cos\theta))e^{j\omega t-(r/c)\cdot(d\cos\theta/c))}$$

wherein C, d, and θ indicates a speed of sound, a distance between the front acoustic terminal and the rear acoustic terminal, and an incident angle formed by a sound wave with respect to the front acoustic terminal 21, respectively.

Consequently, if a pressure gradient is obtained by the difference between the sound pressures $P_1$ and $P_2$ from the sound source $P_0$, the microphone 1 may be said to be unidirectional with respect to the sound source $P_0$.

Figure 5:
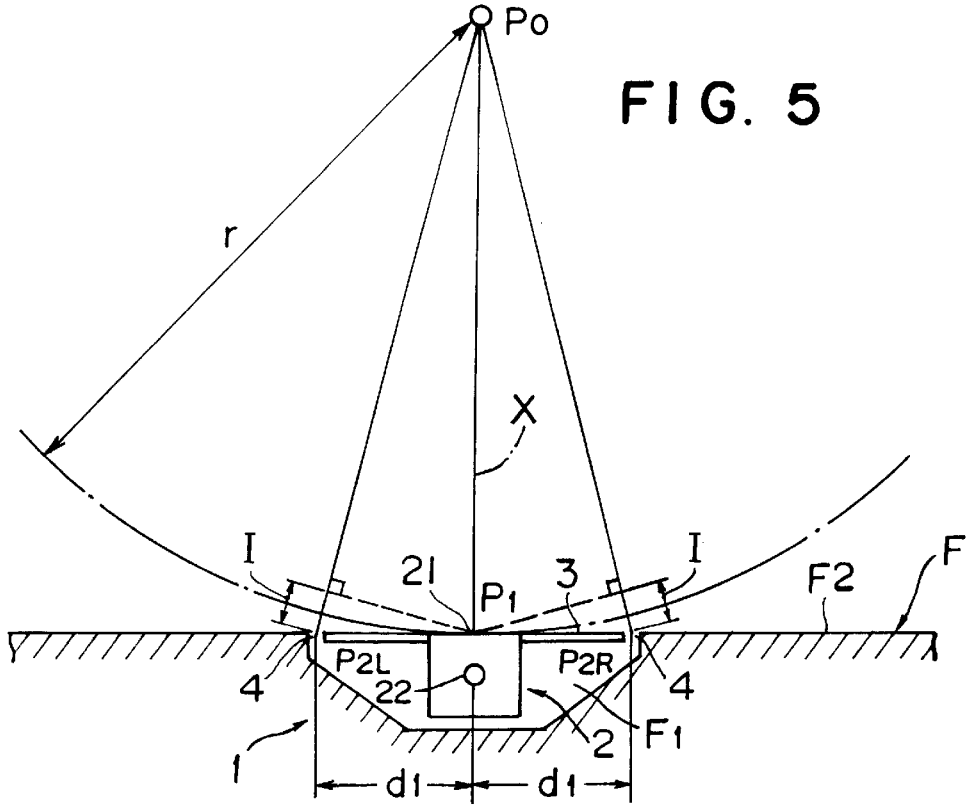
FIG. 5 is a schematic view for explaining the operation of the microphone according to the first embodiment where a sound source is present in a forward direction of the microphone unit.
Figure 6:
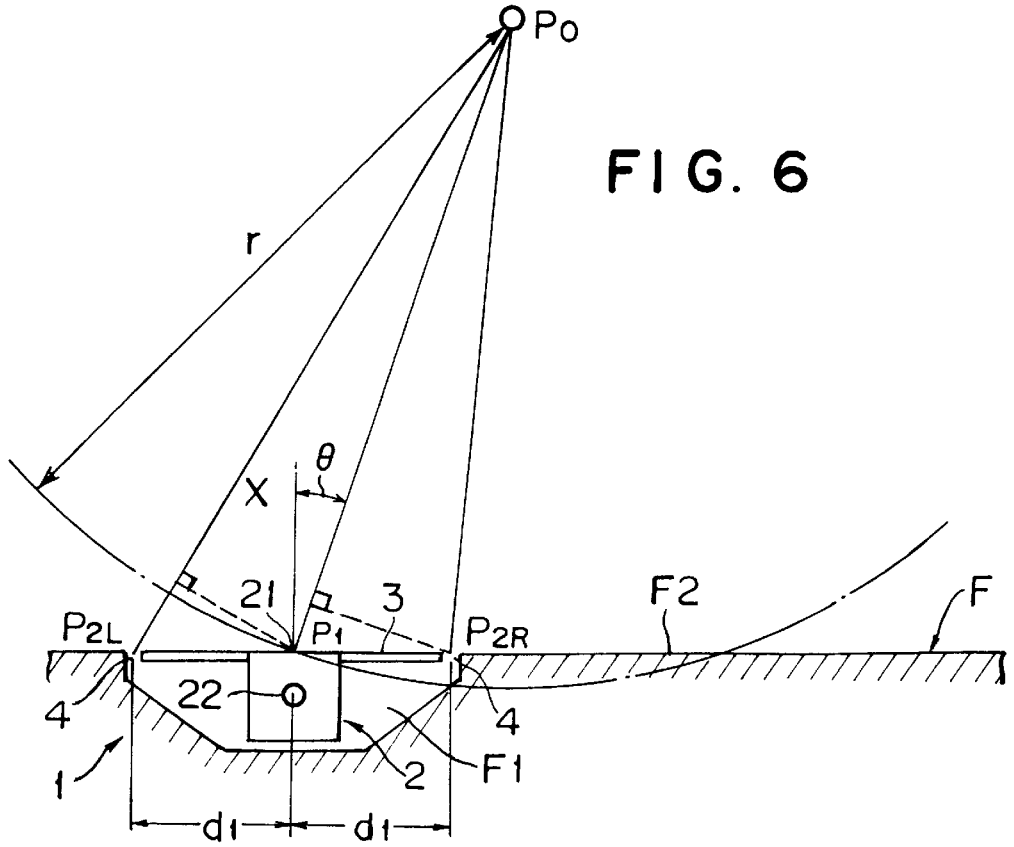
FIG. 6 is a schematic view showing the operation of the microphone according to the first embodiment, in which a sound source is angled to the microphone unit.

The fact that the microphone 1 will be unidirectional can be depicted in FIGS. 5 and 6. That is, FIG. 5 shows that the sound source $P_0$ lies on a main axis X of the microphone unit 2, and FIG. 6 shows that the sound source $P_0$ lies in a position right-towardly deviating from the main axis of the microphone unit 2.

Referring to FIG. 5, the sound source is indicated by $P_0$, and the unidirectional microphone 1 is arranged in front of the sound source $P_0$ so that the spherical wave propagates to the microphone 1 from the sound source $P_0$. As described above, according to the present invention, the side acoustic terminals 4 are provided between the outer edges of the baffle plate 3 and socket for unit F1. Distances between terminals of each of the side acoustic terminals 4 and the main axis of the microphone unit 2 (a position of the front acoustic terminal 21) are indicated by $d_1$, respectively. Further, a main axis of the front acoustic terminal 21 of the microphone unit 2 is indicated by X. The axis X extends from the front acoustic terminal 21 to the sound source $P_0$.

$P_1$ is a position in which a sound pressure of sound wave propagating from the sound source $P_0$ is applied to the front acoustic terminal 21. The axis X extending from $P_1$ and the plane F2 of the outer frame F are at right angles to each other. Sound pressures of the side acoustic terminal 4 on the right and left hands of the axis X are indicated by $P_{2R}$ and $P_{2L}$, respectively.

The sound wave of the spherical wave from the sound source $P_0$ travels to the positions $P_{2R}$ and $P_{2L}$ where the sound pressure is applied to each of the side acoustic terminals 4 on the left and right hands of the axis X. At that time, the sound pressures $P_{2R}$ and $P_{2L}$ come in the side acoustic terminal 4 on the right and left hands behind in phase distance I different than the front acoustic terminal 21. That means that the longer r is, in other words, the further a distance between the sound source $P_0$ and the front acoustic terminal 21 is, the smaller delay in phase distance I is. Further, the smaller the distance between terminals $d_1$ is, the shorter the distance 1 is.

Next, referring to FIG. 6, the sound source $P_0$ deviates rightward from a position of the sound source $P_0$ in FIG. 5. In this case, the sound wave axis propagating from the position where the sound pressure $P_1$ from the sound source $P_0$ is applied to the front acoustic terminal 21, is slanted to an incident angle of θ degree with respect to the main axis X of the microphone unit 2, whereby the sound wave axis propagating from the sound source $P_0$ to the side acoustic terminals 4 on the $P_{2L}$ side also deviates from the sound source $P_0$. As shown in the figure, the position $P_{2L}$ where the sound pressure applied to the side acoustic terminal 4, is outside of the spherical wave.

In addition, the incident sound pressure is in inverse proportion with respect to the microphone 1, wherein the longer the distance between the sound source $P_0$ and the front acoustic terminal, the lower the incident sound pressure, whereby a distant noise from the sound source will be at a low level. Therefore, the microphone 1 does not experience the effects of sound waves coming at low level into the side acoustic terminal 4 at the position $P_{2L}$ after the sound wave from the sound source $P_0$ which is applied to the side acoustic terminal 4 at the position $P_{2R}$. Thus, since there is a phase differential between the sound pressures $P_{2R}$ and $P_{2L}$ at the time when the sound source $P_0$ is in a position in which the sound source $P_0$ deviates rightward from the microphone unit 2, a sound pressure directivity will be produced, based on only the sound pressure on $P_{2R}$, whereby the unidirectivity is created. In the above description, the right and left sound pressures $P_{2R}$ and $P_{2L}$ with respect to the microphone 1 were exemplified. However, according to the unidirectional microphone of the present invention, sound pressures at the upper and lower positions with respect to the microphone 1 also may be described in the same manner.

On the other hand, if a speaker (sound source) nears the microphone 1, the phase differential between the front acoustic terminal 2 and the side acoustic terminals 4 are caused by the spherical wave propagating from the sound source, whereby the microphone unit 2 is able to function as the unidirectivity.

Figure 3B:
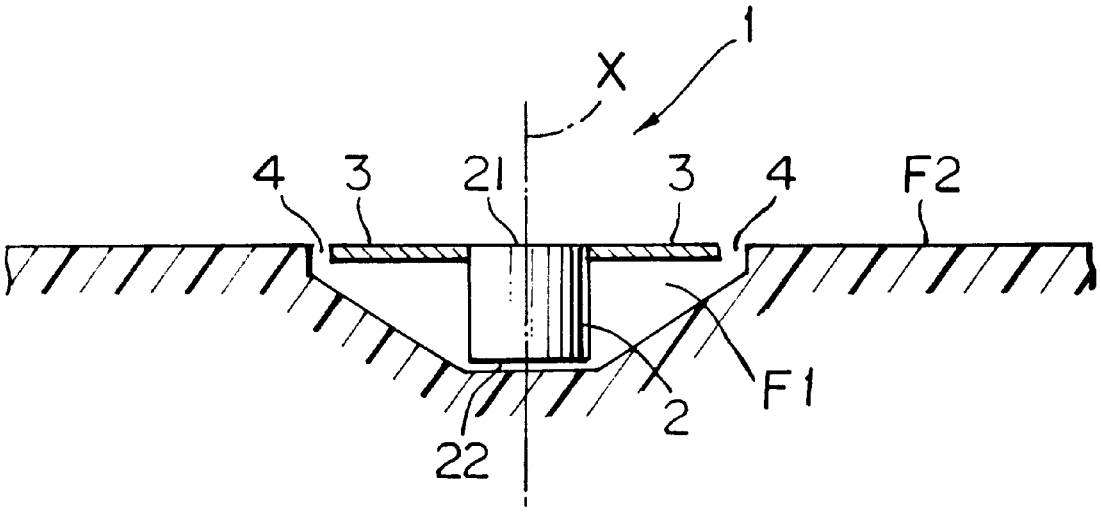

Next, an example of the actual use of the microphone 1 according to the present invention will be described. The unit fitting portion F1 in which the microphone 1 is fit, is formed into a shape in a cone of a speaker-diaphragm described referring to FIGS. 2A and 2B, and an opening of the unit fitting portion F1 is formed into a rectangular shape having a length of 7 cm and a width of 2 cm, the opening surface being formed within a flat plate having a length of 25 cm and a width of 18 cm, as shown in FIG. 3. The microphone unit 2 received in the unit fitting portion F1 is a unidirectional electlet type condenser microphone unit. The side acoustic terminal 4 has a width of 4 mm, which is provided in a gap between both left and right edges of the baffle plate 3 provided around the front acoustic terminal 21 and the unit fitting portion F1.

Figure 7:
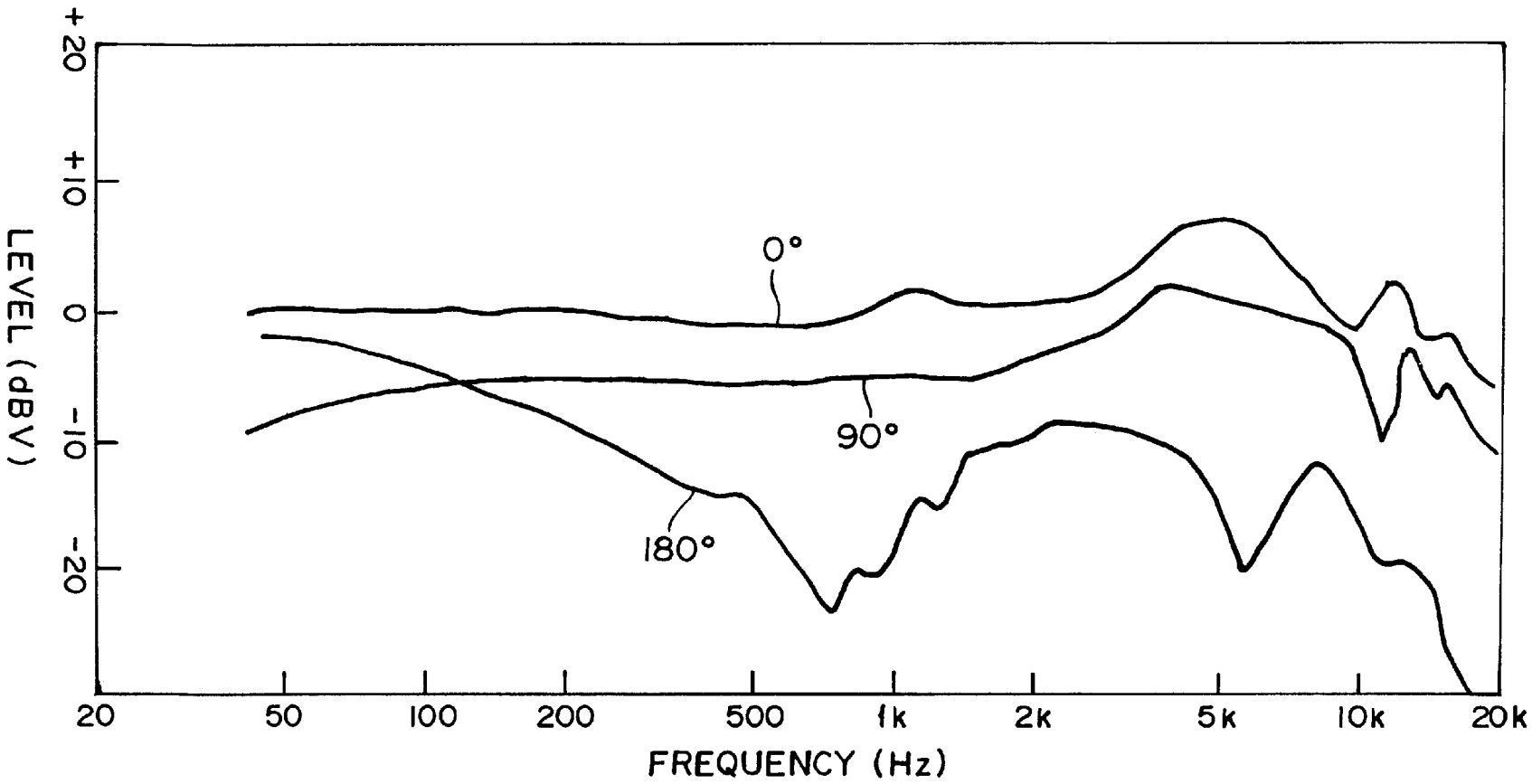
FIG. 7 is a characteristic graph showing the directional characteristic of the microphone relating to the modified embodiment of FIG. 3.
Figure 8:
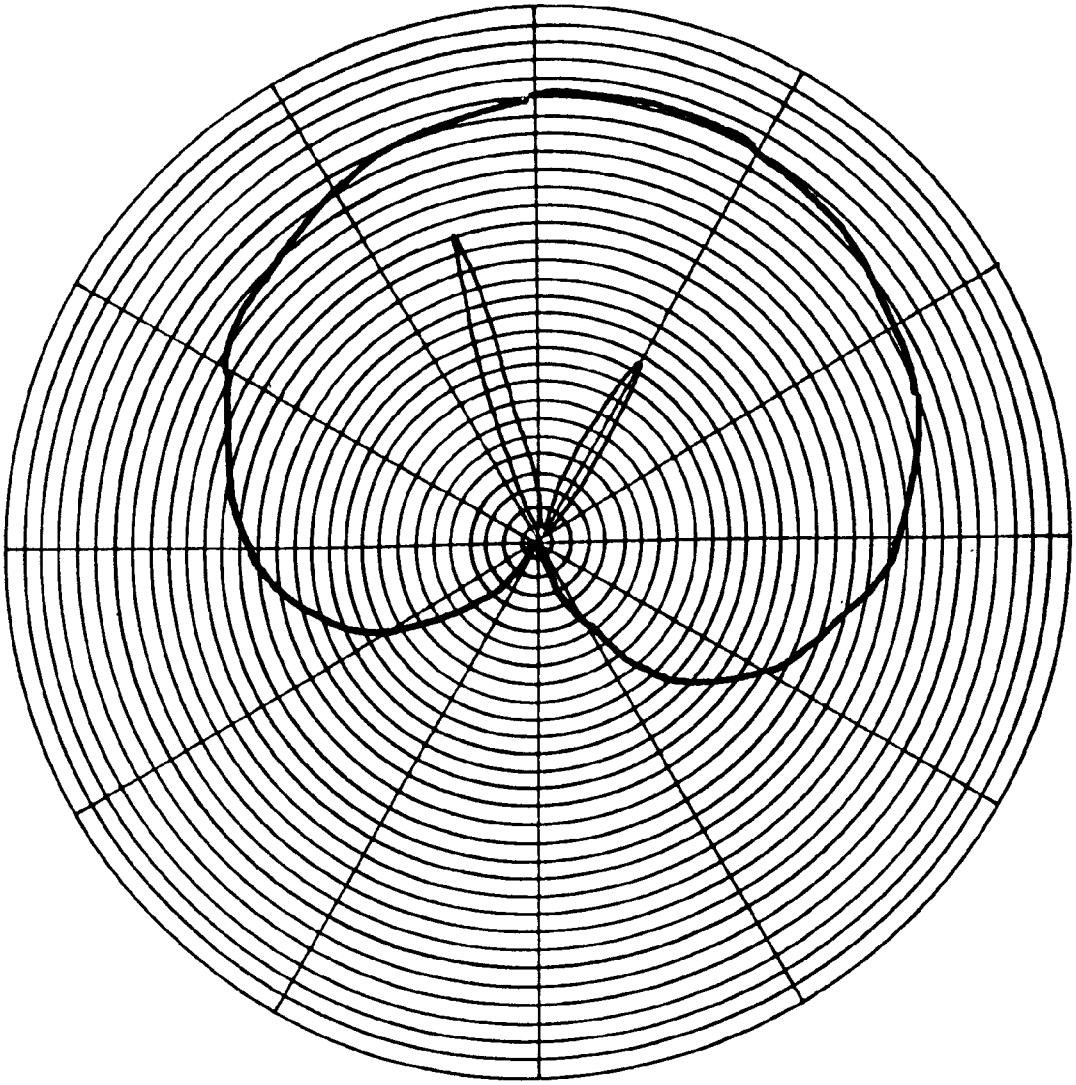
FIG. 8 is a characteristic graph showing an actual measured polar pattern of the microphone relating to the modified embodiment of FIG. 3.

It has been observed that as a result of measurement of a sound absorption characteristic of the microphone 1, an unidirectivity was maintained even in low range, as shown in FIG. 7. In addition, in the measurement of a polar pattern, a hyper-cardioid curve was drawn in FIG. 8.

Figure 9A:
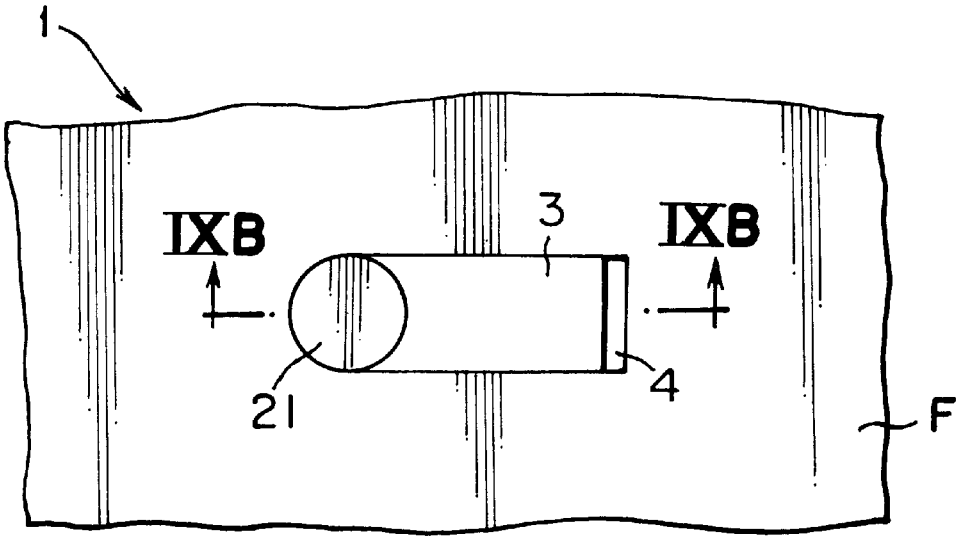
FIGS. 9A and 9B are a plan view and a sectional view taken on line IXB—IXB thereof of a microphone according to a second embodiment, respectively.
Figure 9B:
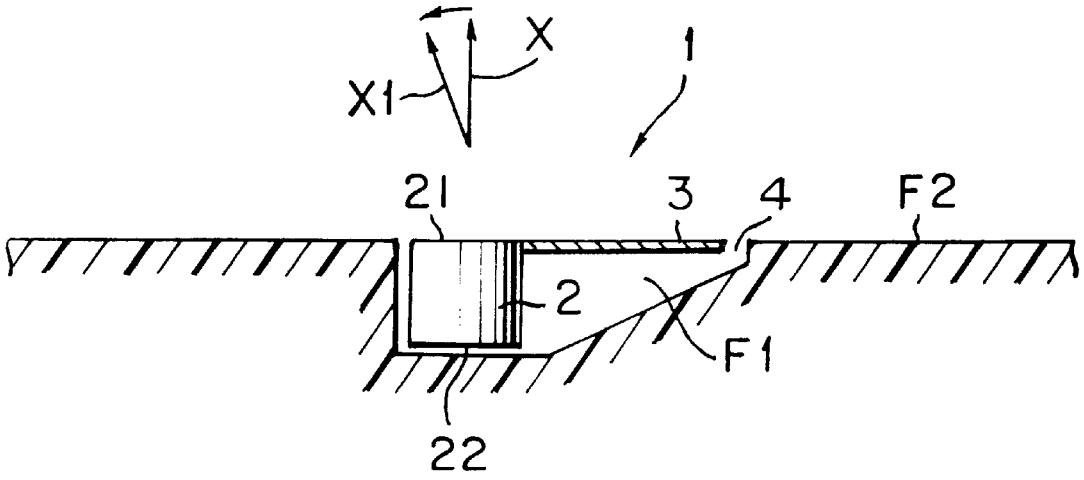

Next, a second embodiment shown in FIG. 9 according to the present invention, will be described hereinafter. FIG. 9A illustrates a plan view of main parts similar to that of FIG. 3A described-above, and FIG. 9B illustrates a sectional view taken along line IXB—IXB of FIG. 9A.

In the microphone 1 according to the second embodiment, there is provided an unit fitting portion formed by a recess having a shape in which one slope of the rectangular recess, as shown in FIG. 3 (the left portion in FIG. 3) is formed. The recess of the unit fitting portion is formed into a cut-out shape of a space portion which corresponds to FIG 3, which is not covered with the left side portion of baffle plate 3. Correspondingly, the microphone unit 2 is provided at the bottom portion surface of the unit fitting portion F1*a* in which the main axis S is vertical with respect to the flat-faced surface F2 of the outer frame F at a center of the front acoustic terminal 21, and further is provided asymmetrically with the side acoustic terminal 4 so that an acoustic directional axis X1 deviates from the main axis X.

Also in the second embodiment, the microphone 1 has the baffle plate 3 mounted in a manner such that the baffle plate 3 is fitted in a rectangular shaped opening surface of a unit fitting portion F1z, and the side acoustic terminal 4 to be coupled to and communicated with the rear acoustic terminal 22 of the microphone unit 2 at the end of the baffle unit.

In the unidirectional microphone, an unidierectivity can be obtained by measuring a phase differential (a sound pressure gradient) I, based on the side acoustic terminal 4 to be coupled to and communicated with the front acoustic terminal 21, and the rear acoustic terminal 22. In the second embodiment, however, the side acoustic terminal 4 is provided on only one side with respect to the front acoustic terminal 21. Accordingly, the acoustic directional axis X1 with respect to the main axis X of the microphone unit 2 is also deviated in a clockwise direction with a predetermined angle. (See FIG. 9B)

Figure 10:
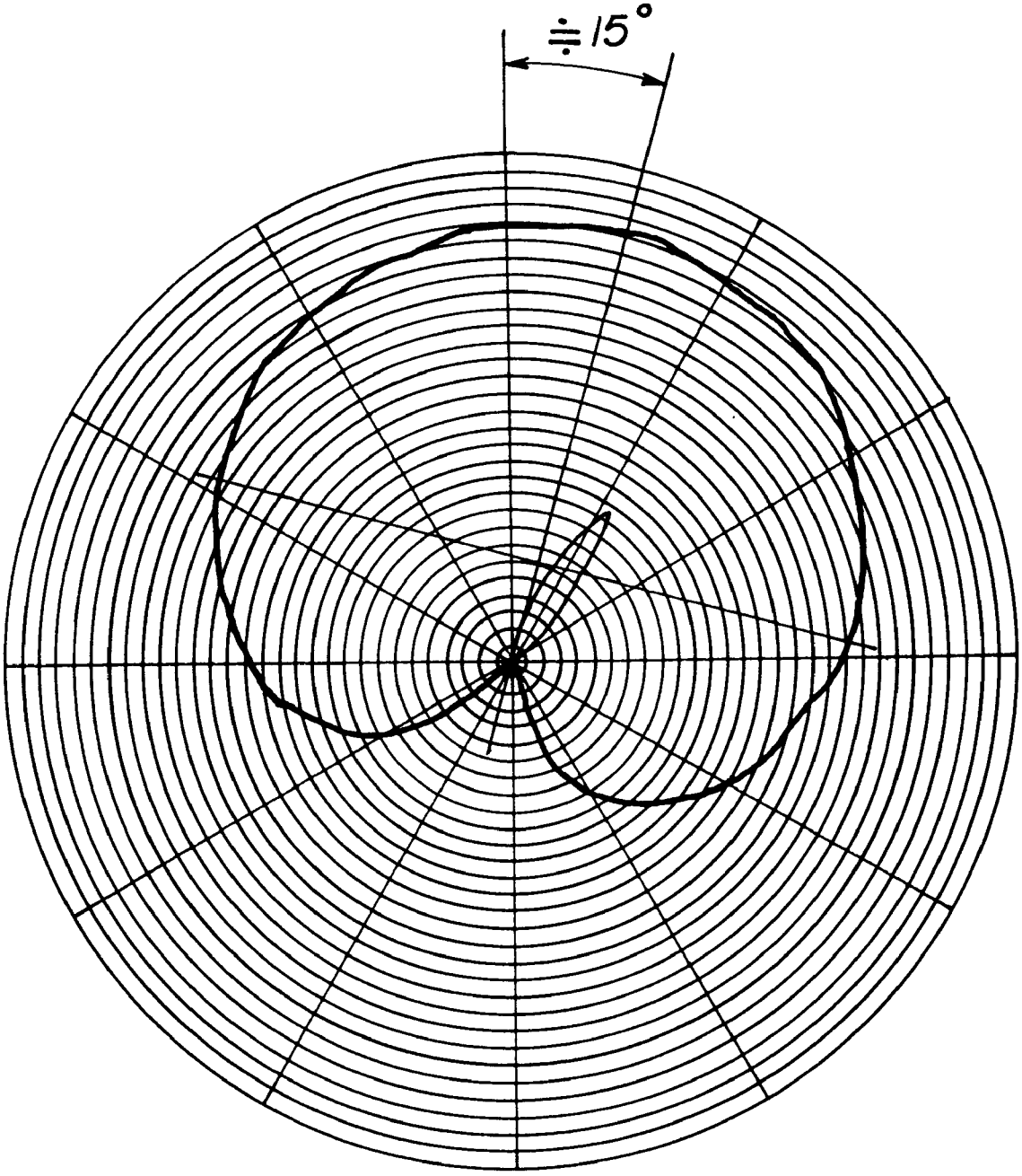
FIG. 10 is a characteristic graph showing an actual measured polar pattern of the microphone according to the second embodiment.

A polar pattern of the second embodiment can be shown in FIG. 10. In this case, the side acoustic terminal 4 is formed on the side thereof of a position where is 1 cm away from the front acoustic terminal 21. It will be clear from the figure that the acoustic directional axis X1 is at a position where is approximately 15 degrees away from the main axis X of the microphone unit 2.

As described above, the acoustic directional axis X1 can be deviated with a predetermined angle with respect to the main axis X of the microphone unit 2, whereby it is possible for a directivity to be directed toward a mouth of a speaker (user), even in the case of a personal computer having a microphone to be mounted in the limited space. In the second embodiment, although the rectangular-shaped baffle plate was exemplified, however, in the case that the opening surface of the cone speaker-shaped recess described in the first embodiment will be deformed into a semi-circular shape, a semi-circular baffle plate may be provided.

Figure 11A:
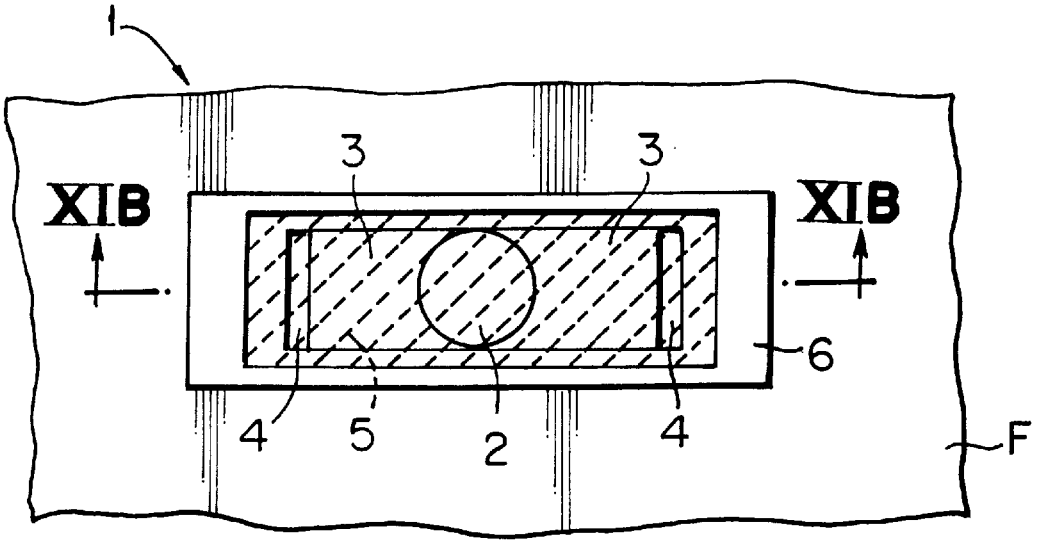
FIGS. 11A and 11B are a plan view and a sectional view taken on line XIB—XIB of the microphone according to the second embodiment, respectively.
Figure 11B:
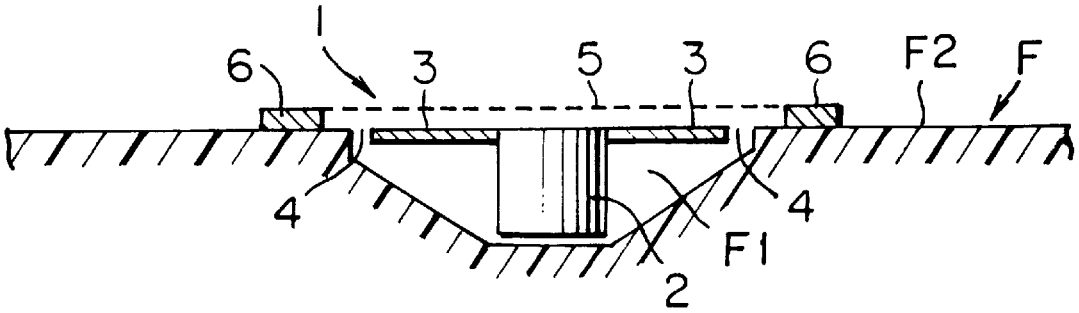

Further, according to the present invention, it is possible to provide simple members for preventing the microphone 1 from water. FIGS. 11A and 11B illustrates a plan view of a third embodiment of the present invention, and a sectional view taken on line XIB—XIB thereof, respectively.

According to the figures, for the microphone 1, the preventive members can be provided by a water-proof frame 6 disposed about the unit fitting portion F1 and a water-proof film 5 spread over the water-proof frame 6.

Conventionally, there was nothing else preventive members such as water-proof films which are spread over each of the front acoustic terminal 21 and the rear acoustic terminal 22. However, according to the third embodiment, the water-proof film 5 will be corresponded to only the flat-faced surface F2, because the front acoustic terminal 21 and the side acoustic terminal 4 are at an approximately same level as that of the flat-faced surface F2. Therefore, it is possible to prevent the microphone 1 from water by such easier and inexpensive members.

Conversely, in the respective embodiments described above, as examples of the flat-faced surface on which the unidirectional microphone unit is mounted, the display panel portion of the note-book type personal computer has been exemplified. However, the unidirectional microphone of the present invention should not be limited to the scope of the examples. The flat-faced surface on which the unidirectional microphone is mounted, may be those which are used for a body of a personal computer and a desk top system personal computer and other electronic apparatuses or electric apparatuses, for examples.

As described above, the present invention exhibits the following effects. It is possible to maintain the excellent unidirectivity for even a microphone provided on a plane position which is at approximately same level as that of the flat-faced surface of a personal computer and a display, for example. Accordingly, it is possible to absorb an objective sound with excellent state under the circumstances in which noises are produced.

Further, it is possible to shift the acoustic directional axis with respect to the main axis of the microphone unit by making the side acoustic terminal to be arranged symmetrically with respect to the front acoustic terminal. It is meant that it is possible to lean the acoustic directional axis of the microphone unit in any directions of a speaker, for example, with respect to the main axis thereof. Therefor, particularly, in a personal computer having a limited space for mounting a microphone, it is possible to make the directivity to be directed to the mouth of the speaker.

It should not be recognized that requirements of the microphone unit is directed to a special unit. An inexpensive microphone such as a unidirectional electlet condenser type generally used, may also be applied.

In addition, it is possible to make the microphone at low cost, because parts such as the baffle plate can be obtained at low cost. Furthermore, it is possible to prevent the microphone from water by the easier and inexpensive members.

What is claimed is:

1. A unidirectional microphone including a generally cylindrical microphone unit mounted in a microphone unit containing portion, the microphone unit having a top surface, a bottom surface, and a side surface; a baffle plate having a certain diameter disposed about the side of the microphone unit at its top end, a housing having an opening which is of a larger diameter than the baffle plate diameter, the opening being formed substantially parallel to the top surface of the housing; said microphone unit-containing portion extending from said opening of the housing to a bottom of the housing for containing said microphone unit with said baffle plate; a front acoustic terminal at the top surface of said microphone unit; a rear acoustic terminal at the bottom surface of said microphone unit; a side acoustic terminal connected to the rear acoustic terminal; and said baffle plate at the opening surface of the housing, said unidirectional microphone further including:

said baffle plate being of a smaller diameter than that of the opening of said housing thereby forming a gap between said baffle plate and said microphone unit containing portion; and a passageway formed between the bottom of said microphone unit containing portion and said gap so that said rear acoustic terminal communicates with said side acoustic terminal.

2. The unidirectional microphone according to claim 1, wherein said side acoustic terminal is formed by at least one or more through-holes bored on the surface of the baffle plate.

3. The unidirectional microphone according to claim 1, wherein said passageway comprises a slope from a top portion to a bottom portion in an inner surface of said microphone unit-fitting portion.

4. The unidirectional microphone according to claim 1, wherein said housing has a pair of said microphone unit containing portions and wherein a pair of said unidirectional microphones are provided in said pair of microphone unit containing portions to be operated as a stereo microphone.

5. The unidirectional microphone according to claim 1, where in said housing including mounting means provided about said opening, and a waterproof film provided to said mounting means for covering the opening surface of said unit fitting portion.

6. The microphone unit according to claim 1, wherein when sound source is at a main axis of the microphone unit, said side acoustic terminal receives sound pressure behind or at a late time relative to said front acoustic terminal, and wherein when said sound source is at one side with respect to the main axis of the microphone unit, said side acoustic terminal on the side of said sound pressure operates with unidirectional properties.

7. A unidirectional microphone including a microphone unit which is of generally cylindrical shape, the microphone unit being mounted in a microphone unit containing portion and having a top surface, a bottom surface, and a side surface, a baffle plate disposed about the side of the microphone unit at one end, a housing having an opening surface larger than the baffle plate, the opening surface being substantially parallel to the top surface of said housing, a microphone unit-containing portion extending from said opening surface of the housing to a housing bottom for containing said microphone unit with said baffle plate, a front acoustic terminal at the top surface of said microphone unit, a rear acoustic terminal at the bottom surface of said microphone unit, a side acoustic terminal connected to the rear acoustic terminal, and baffle plate at the first opening surface of the housing, said unidirectional microphone further including:

said microphone unit being positioned substantially at the center of said baffle plate;

said opening surface extending in the width direction with respect to its center and forming a pair of gaps between said baffle plate and said microphone unit containing portion at both ends thereof; and a pair of passageways formed between the bottom of said microphone unit containing portion and said gap so that said rear acoustic terminal communicates with said side acoustic terminals.

8. A unidirectional microphone according to claim 7, wherein said housing has a pair of said microphone unit containing portions and wherein a pair of said unidirectional microphones are provided to said pair of microphone unit containing portions to be operated as a stereo microphone.

9. A unidirectional microphone according to claim 7, wherein said pair of passageways comprise slopes from a substaintially top end to the bottom in an inner surface of said microphone unit containing portion.

10. A unidirectional microphone according to claim 7, wherein said housing includes mounting means about said opening surface, and a waterproof film at said mounting means for covering the opeining surface of said microphone unit containing portion.

11. The microphone unit according to claim 7, wherein when a sound source is at a main axis of the microphone unit, said side acoustic terminal receives the sound pressure later then said front acoustic terminal, and wherein when said sound source is at a side with respect to the main axis of the microphone unit, said side acoustic terminal on the side of said sound pressure operates with unidirectional properties.

12. A unidirectional microphone including a microphone unit which is of generally cylindrical shape, the microphone unit being mounted in a microphone unit containing portion and having a top surface, a bottom surface, and a side surface, a baffle plate disposed about the side of the microphone unit at its top end, a housing having an opening surface larger than the baffle plate, the opening surface being substantially parallel to the top surface of said housing, said microphone unit-containing portion extending from said opening surface of the housing to a housing bottom for containing said microphone, a front acoustic terminal at the top surface of said microphone unit, a rear acoustic terminal at the bottom surface of said microphone unit, a side acoustic terminal connected with the rear acoustic terminal, and said baffle plate at the opening of the housing, said unidirectional microphone further including:

said microphone unit being positioned on either side of said baffle plate;

said opening surface being longer;

said baffle plate so as to form a gap between said baffler plate and said microphone unit containing portion located at either side thereof;

said side acoustic terminal which comprises said gap; and a passageway formed between the bottom of said unit fitting portion and said gap so that said rear acoustic terminal communicates with said side acoustic terminal.

13. The unidirectional microphone according to claim 12, wherein said baffle plate is formed in the shape of a semicircle or a rectangle.

14. The unidirectional microphone according to claim 12, wherein said passageway comprises a slope from a top microphone end to a bottom microphone portion in an inner surface of said microphone unit containing portion.

15. The unidirectional microphone according to claim 12, wherein said housing includes mounting means provided about said opening surface, and a waterproof film at said mounting means for covering the opening surface of said microphone unit containing portion.

16. The unidirectional microphone according to claim 12, wherein when a sound source is at a main axis of the microphone unit, said side acoustic terminal receives sound pressure later than said front acoustic terminal, and wherein when said sound source is at a side with respect to the main axis of the microphone unit, said side acoustic terminal on the side of said sound pressure operates with unidirectional properties.

17. The microphone unit according to claim 16, wherein an acoustic direction axis of said microphone unit is at about a 15 degree angle with respect to the main axis of said sound source.

18. A unidirectional microphone including a microphone unit having a top surface, a bottom surface, and a side surface;

a front acoustic terminal provided on the top surface of said microphone unit;

a rear acoustic terminal provided on the bottom surface of said microphone unit;

a baffle plate provided on a top end portion of the side surface of said microphone unit;

an opening surface formed on a flat-faced plate, whose height is at same level as the top surface of said microphone unit;

said flat-faced plate being formed by a display panel for a computer and said unidirectional microphone comprises at least one or more microphones provided on the flat-faced plate;

a unit fitting portion for fitting said microphone unit therein, the unit fitting portion having a bottom surface and a slope formed from said opening surface toward the bottom surface; and a side acoustic terminal provided in said unit fitting portion for communicating a sound pressure to the rear acoustic terminal.

* * * * *